US007212087B2

(12) United States Patent
Nagai

(10) Patent No.: US 7,212,087 B2
(45) Date of Patent: May 1, 2007

(54) TWISTED WAVEGUIDE AND WIRELESS DEVICE

(75) Inventor: Tomohiro Nagai, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 63 days.

(21) Appl. No.: 10/533,134

(22) PCT Filed: Aug. 5, 2004

(86) PCT No.: PCT/JP2004/011243

§ 371 (c)(1),
(2), (4) Date: Apr. 29, 2005

(87) PCT Pub. No.: WO2005/034278

PCT Pub. Date: Apr. 14, 2005

(65) Prior Publication Data

US 2006/0097816 A1 May 11, 2006

(30) Foreign Application Priority Data

Oct. 6, 2003 (JP) ..... 2003-347471

(51) Int. Cl.
*H01P 1/20* (2006.01)

(52) U.S. Cl. ..... 333/210; 333/21 A; 333/21 R; 343/756

(58) Field of Classification Search ..... 333/21 A, 333/21 R, 210; 343/756
See application file for complete search history.

(56) References Cited

U.S. PATENT DOCUMENTS 2,975,383 A * 3/1961 Seling ..... 333/21 A
6,583,685 B1 * 6/2003 Easter et al. ..... 333/32
6,995,628 B2 * 2/2006 Asao et al. ..... 333/21 A

FOREIGN PATENT DOCUMENTS

JP 62-23201 1/1987
JP 2-30602 2/1990

OTHER PUBLICATIONS

Copies of the PCT/ISA/210, PCT/ISA/220, and PCT/ISA/237 Forms issued for the parent PCT Application.

* cited by examiner

*Primary Examiner*—Robert Pascal
*Assistant Examiner*—Kimberly E Glenn
(74) *Attorney, Agent, or Firm*—Dickstein, Shapiro, LLP.

(57) ABSTRACT

H plane and E plane of a second rectangular waveguide element are inclined at an angle of 45° with respect to H plane and E plane of a first rectangular waveguide element. A connection element disposed between the first and second rectangular waveguide elements has an inner periphery that surrounds a central axis extending in a direction of electromagnetic-wave propagation. The inner periphery includes surfaces parallel to H plane and E plane of the first rectangular propagation path element, and these surfaces form a staircase such that abutting sections between the surfaces parallel to H plane and the surfaces parallel to E plane constitute projections. The staircase is inclined in a direction corresponding to a direction in which H plane of the second rectangular propagation path element is inclined. Accordingly, an electric field is concentrated in the projections of the connection element, and a plane of polarization of an electromagnetic wave propagating through the connection element is rotated from a plane of polarization in the first rectangular waveguide element towards a plane of polarization in the second rectangular waveguide element.

5 Claims, 9 Drawing Sheets

TWISTED WAVEGUIDE AND WIRELESS DEVICE

CROSS REFERENCE TO RELATED APPLICATIONS

The present application is a national stage of PCT/JP2004/011243, filed Aug. 5, 2004, which claims priority to Japanese application No. 2003-347471, filed Oct. 6, 2003.

FIELD OF THE INVENTION

The present invention relates to a twisted waveguide that is capable of rotating a plane of polarization of an electromagnetic wave propagating through two rectangular propagation path elements.

BACKGROUND OF THE INVENTION

FIG. 14 illustrates a most-commonly-used conventional twisted waveguide, which is a rectangular waveguide having a twisted structure. Since a rapid twisting of a twisted waveguide having such a structure is not allowed during its manufacturing process, the waveguide requires a predetermined length in the propagation direction of an electromagnetic wave. Moreover, the waveguide also requires a large space in the joint portions. Japanese Unexamined Patent Application Publication No. 62-23201 ("Patent Document 1") discloses a structure for solving these problems. Specifically, FIG. 15 illustrates the structure of a twisted waveguide according to Patent Document 1. In this twisted waveguide, a second rectangular waveguide element 2 is attached in a manner such that the second rectangular waveguide element 2 is inclined at a predetermined angle with respect to a first rectangular waveguide element 1. Furthermore, a resonant window or filter window 3 having a transmission center frequency as a predetermined frequency is disposed between the first rectangular propagation path element and the second rectangular waveguide element 2 such that a plane of polarization is inclined at ½ of the predetermined angle mentioned above.

SUMMARY OF THE INVENTION

However, the structure shown in FIG. 15 is problematic in that the resonant window or filter window must have an extremely small dimension in order to be used in a high frequency wave, such as in a W band (75 to 110 GHz). This complicates the manufacturing process of the window, and moreover, narrows the utilizable frequency range due to the utilization of resonance.

Accordingly, it is an object of the present invention to solve the problems mentioned above by providing a twisted waveguide having a wide utilizable frequency range without requiring a large dimension of a space used for rotating a plane of polarization, and by providing a wireless device equipped with such a twisted waveguide.

A twisted waveguide according to the present invention includes first and second rectangular propagation path elements having different planes of polarization; and a connection element connecting the first and second rectangular propagation path elements together. The connection element has a fixed line length in a direction of electromagnetic-wave propagation of the first and second rectangular propagation path elements. The connection element includes projections projected inward so as to face each other, the projections concentrating an electric field of an electromagnetic wave entering from the first or second rectangular propagation path element and rotating a plane of polarization of the electromagnetic wave propagating through the connection element.

Furthermore, in the twisted waveguide according to the present invention, an inner periphery of the connection element surrounding a central axis extending in the direction of electromagnetic-wave propagation of the first and second rectangular propagation path elements may include surfaces substantially parallel to H plane and E plane of the first rectangular propagation path element. In this case, these surfaces form a staircase such that abutting sections between the surfaces parallel to H plane and the surfaces parallel to E plane constitute the projections. Moreover, the staircase is inclined in a direction corresponding to a direction in which H plane of the second rectangular propagation path element is inclined.

Furthermore, in the twisted waveguide according to the present invention, the projections may include two projections provided at two positions such that a plane extending between the two projections is inclined towards E plane of the second rectangular propagation path element with respect to E plane of the first rectangular propagation path element.

Furthermore, in the twisted waveguide according to the present invention, the line length of the connection element in the direction of electromagnetic-wave propagation may be substantially ½ of a guide wavelength with respect to a frequency of an electromagnetic wave to be propagated through the connection element.

Furthermore, in the twisted waveguide according to the present invention, the connection element may include a plurality of subelements disposed at multiple positions in the direction of electromagnetic-wave propagation.

A wireless device according to the present invention includes the twisted waveguide having one of the above structures; and an antenna connected to one of the first and second rectangular propagation path elements included in the twisted waveguide.

According to the present invention, a connection element disposed between first and second rectangular propagation path elements is provided with projections projected inward so as to face each other. Thus, an electric field of an electromagnetic wave entering from the first or second rectangular propagation path element is concentrated in the projections, and a plane of polarization of the electromagnetic wave propagating through the connection element is rotated. Consequently, the plane of polarization is rotated in the connection element from the first rectangular propagation path element towards the second rectangular propagation path element or from the second rectangular propagation path element towards the first rectangular propagation path element. Since such a structure does not require a resonant window or a filter window shown in FIG. 15, a wide frequency range characteristic can be achieved. Furthermore, according to this structure, since the plane of polarization is not rotated by a rectangular waveguide whose overall structure is twisted, the plane of polarization of an electromagnetic wave can be rotated within a narrow space.

Furthermore, according to the present invention, an inner periphery of the connection element may be provided with surfaces substantially parallel to H plane and E plane of the first rectangular propagation path element. Specifically, the surfaces form a staircase such that abutting sections between the surfaces parallel to H plane and the surfaces parallel to E plane constitute the projections. Moreover, the staircase may be inclined in a direction corresponding to a direction in which H plane of the second rectangular propagation path element is inclined. Accordingly, each of the elements can be formed only of flat surfaces and parallel surfaces, whereby the manufacturing process for the first and second rectangular propagation path elements and the connection element is simplified. This reduces the manufacturing cost, and therefore, contributes to the reduction of the overall cost.

Furthermore, according to the present invention, the projections may include two projections such that a plane extending between the two projections may be inclined towards E plane of the second rectangular propagation path element with respect to E plane of the first rectangular propagation path element. Accordingly, the plane of polarization of the electromagnetic wave propagating through the connection element can be rotated with only two projections, whereby the overall structure is simplified. This further reduces the manufacturing cost.

Furthermore, according to the present invention, the dimension of the connection element in the direction of electromagnetic-wave propagation may be substantially ½ of a guide wavelength with respect to a frequency of an electromagnetic wave to be propagated through the connection element. Thus, a consistency between the connection element and the first and second rectangular propagation path elements at the frequency corresponding to the guide wavelength can be achieved. In other words, the reflection coefficient at the bordering section between the first rectangular propagation path element and the connection element and the reflection coefficient at the bordering section between the second rectangular propagation path element and the connection element have reversed polarities such that two reflection waves have opposite phases and thus overlap. Accordingly, the two reflection waves counteract each other, whereby a low reflection loss is achieved.

Furthermore, according to the present invention, the connection element may include a plurality of subelements disposed at multiple positions in the direction of electromagnetic-wave propagation. Accordingly, even when a rotation angle of a plane of polarization is not sufficiently obtained at a first connection subelement, the total rotation angle obtained is large. Moreover, the structural differences at the bordering sections between the connection element and the first and second rectangular propagation path elements can be reduced, thereby achieving a low reflection loss.

Furthermore, according to the present invention, a wireless device can be readily provided in which the device can send or receive an electromagnetic wave with a plane of polarization different from a plane of polarization in a propagation path through which a sending signal or a receiving signal propagates. For example, the device can send or receive an electromagnetic wave whose plane of polarization is inclined at a predetermined angle with respect to a horizontal plane.

BRIEF DESCRIPTION OF THE DRAWINGS

FIG. 2 FIGS. 2A, 2B and 2C are cross-sectional views each illustrating an element of the twisted waveguide of FIG. 1 and an electric-field distribution of an electromagnetic wave.

REFERENCE NUMERALS SHOWN IN THE DRAWINGS

Figure 1:
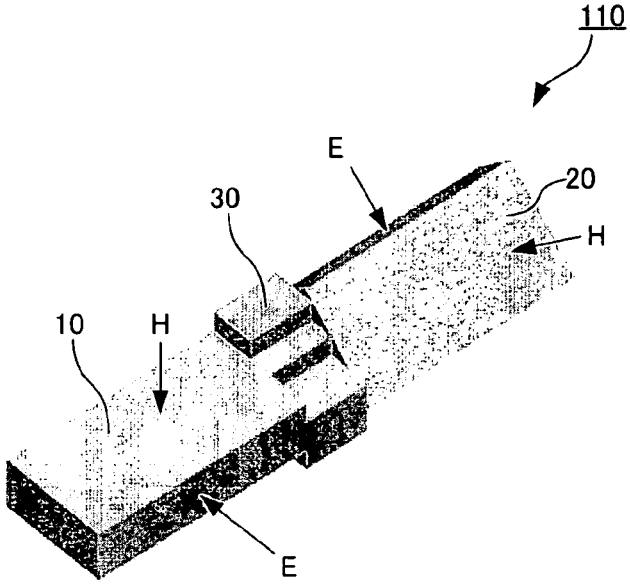
FIG. 1 is a perspective view illustrating a three-dimensional configuration of an electromagnetic-wave propagation path of a twisted waveguide according to a first embodiment of the present invention.

0 central axis
10 first rectangular waveguide element
20 second rectangular waveguide element
21 rectangular horn
30 connection element
31, 32 projection
40 dielectric lens
100, 101, 102 metal block
110 twisted waveguide
110' primary radiator
R edge line

DETAILED DESCRIPTION OF PREFERRED EMBODIMENTS OF THE INVENTION

A twisted waveguide according to a first embodiment will now be described with reference to FIGS. 1 to 3.

FIG. 1 is a perspective view illustrating a three-dimensional configuration of an inside (electromagnetic-wave propagation path) of a twisted waveguide 110. The twisted waveguide 110 includes a first rectangular waveguide element 10 corresponding to a first rectangular propagation path; a second rectangular waveguide element 20 corresponding to a second rectangular propagation path element; and a connection element 30 connecting the first rectangular waveguide element 10 and the second retangular waveguide element 20. The first rectangular waveguide element 10 and the second rectangular waveguide element 20 propagate an electromagnetic wave of TE10 mode and each have an H plane extending longitudinally and an E plane extending laterally when viewed in cross section taken along a plane perpendicular to a direction of electromagnetic-wave propagation. The reference characters H in FIG. 1 each indicate a surface parallel to a loop plane (H plane) of a magnetic field. Each reference character E indicates a surface parallel to a plane (E plane) extending parallel to a direction of an electric field. The first rectangular waveguide element 10, the second rectangular waveguide element 20, and the connection element 30 have a common central axis O (FIGS. 2A–2C) collinearly extending in the direction of electromagnetic-wave propagation.

If H plane of the first rectangular waveguide element 10 is parallel to a horizontal plane and E plane is parallel to a vertical line, H plane and E plane of the second rectangular waveguide element 20 are tilted at an angle of 45° about the central axis extending in the direction of electromagnetic-wave propagation.

The connection element 30 has a fixed line length in the direction of electromagnetic-wave propagation of the first and second rectangular waveguide elements 10 and 20, and is capable of rotating a plane of polarization of an electromagnetic wave received from the first rectangular waveguide element 10 or the second rectangular waveguide element 20 so that a conversion can be performed between a plane of polarization of the first rectangular waveguide element 10 and a plane of polarization of the second rectangular waveguide element 20.

Figure 2A:
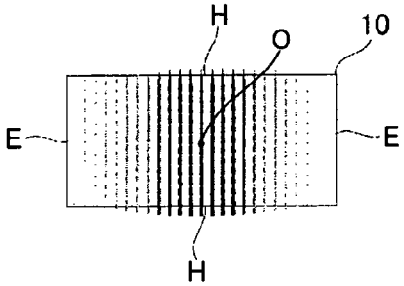
Figure 2C:
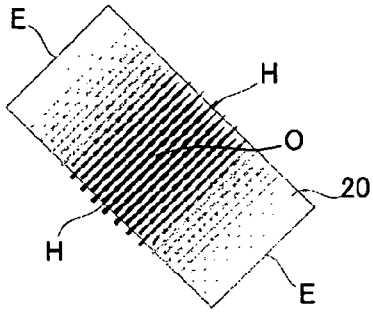
Figure 2B:
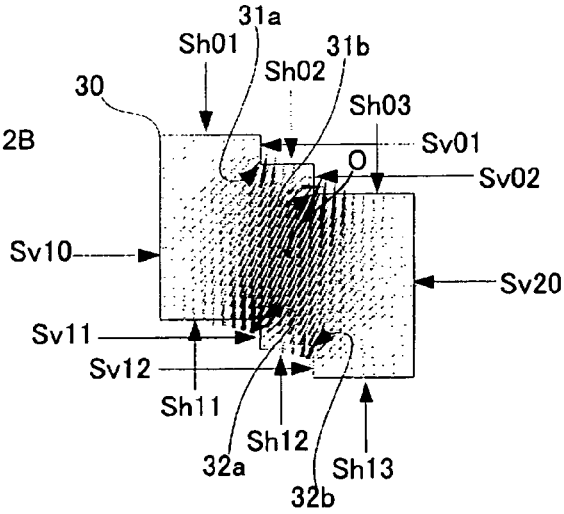

FIG. 2A through 2C are cross-sectional views of the elements shown in FIG. 1 each cross-sectional view is taken along a plane perpendicular to the direction of electromagnetic-wave propagation. Similar to FIG. 1, only an internal space of the electromagnetic-wave propagation path is shown. Specifically, FIG. 2A is a cross-sectional view of the first rectangular waveguide element 10, FIG. 2C is a cross-sectional view of the second rectangular waveguide element 20, and FIG. 2B is a cross-sectional view of the connection element 30. A pattern including multiple triangles in each drawing indicates an electric-field distribution of an electromagnetic wave of TE10 mode propagating through the twisted waveguide. In other words, the pointing direction of the triangles of the pattern indicates the direction of the electric field, and the size and the density of the triangles of the pattern indicate the magnitude of the electric field. In FIGS. 2A and 2C, each reference character H indicates a surface parallel to H plane, and each reference character E indicates a surface parallel to E plane. Referring to FIGS. 2A FIGS. 2A and 2C, the electric field of TE10 mode extends in a direction parallel to E plane, and the intensity of the electric field is greater towards the center of each waveguide element. As described above, the first rectangular waveguide element 10, the second rectangular waveguide element 20, and the connection element 30 have a common central axis O collinearly extending in the direction of electromagnetic-wave propagation.

Referring to FIG. 2B, the connection element 30 is provided with a pair of projections 31*a*, 32*a* projected inward so as to face each other, and a pair of projections 31*b*, 32*b* also projected inward so as to face each other. The inner periphery of the connection element 30 includes surfaces Sh01, Sh02, Sh03, Sh11, Sh12, Sh13 which are parallel to H plane of the first rectangular waveguide element 10; and surfaces Sv01, Sv02, Sv11, Sv12, Sv10, Sv20 which are parallel to E plane of the first rectangular waveguide element 10. These surfaces parallel to H plane and the surfaces parallel to E plane constitute a staircase-like structure. The direction of inclination of the staircase corresponds to the direction in which H plane of the second rectangular waveguide element 20 is inclined. In this embodiment, the staircase is inclined at an angle of 22.5°, which is substantially ½ of the angle of inclination of H plane of the second rectangular waveguide element 20.

Abutting sections among the surfaces parallel to H plane and the surfaces parallel to E plane of the first rectangular waveguide element 10 constitute the projections 31*a*, 32*a*, 31*b*, 32*b* mentioned above. Consequently, the electric field is concentrated in these regions of the projections 31*a*, 32*a*, 31*b*, 32*b* projected inward of the connection element 30. For this reason, a change in the direction of the electric field is generated between the projections at the upper side and the projections at the lower side of the connection element 30 in the drawing. This tilts the plane of polarization of the electromagnetic wave in the connection element 30, thereby rotating the plane of polarization of the electromagnetic wave propagating through the connection element 30.

Referring to FIGS. 1, 2A, 2B and 2C, the waveguide element 10 and the waveguide element 20 have different planes of polarization but have the same cross-sectional structure. For this reason, a reflection coefficient as viewed from the side of the waveguide element 10 towards the connection element 30 and a reflection coefficient as viewed from the side of the waveguide element 20 towards the connection element 30 can be made equal to each other in a relatively easy manner by adjusting the height of the projections and the width of the projections in the connection element 30. When the reflection coefficient viewed from the side of the waveguide element 10 towards the connection element 30 and the reflection coefficient viewed from the side of the waveguide element 20 towards the connection element 30 are equal to each other, the reflection coefficient viewed from the side of the waveguide element 10 towards the connection element 30 and the reflection coefficient viewed from the side of the connection element 30 towards the waveguide element 20 have the same magnitude with reversed polarities.

In this case, if the line length of the connection element 30 is set at ½ of the guide wavelength, and supposing that an electromagnetic wave propagates from the waveguide element 10 to the waveguide element 20, a reflective wave at a bordering section between the waveguide element 10 and the connection element 30 and a reflective wave at a bordering section between the connection element 30 and the waveguide element 20 overlap while being deviated from each other by one wavelength. Since the reflective waves of the reversed polarities overlap with each other, the reflective waves counteract each other.

Figure 3:
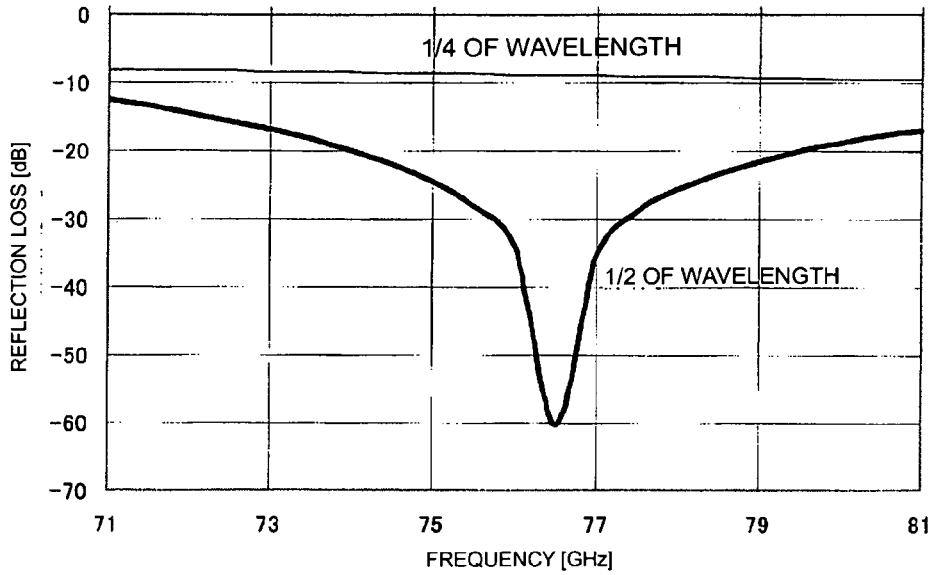
FIG. 3 illustrates reflection-loss-versus-frequency characteristics of the twisted waveguide of FIG. 1.

FIG. 3 illustrates reflection-loss-versus-frequency characteristics of the twisted waveguide in a case where the two reflection coefficients mentioned above have reversed polarities. The bold line in FIG. 3 indicates a characteristic in a case where the line length of the connection element is set at ½ of the guide wavelength at the design frequency. On the other hand, the thin line corresponds to a comparative example and indicates a characteristic in a case where the line length is set at ¼ of the guide wavelength at the design frequency. If the line length of the connection element is set at ¼ of the guide wavelength, a large reflection loss of about −9 dB is caused due to reflections generated at the bordering planes between the first rectangular waveguide element and the connection element and between the second rectangular waveguide element and the connection element. On the other hand, if the line length of the connection element 30 is set at ½ of the guide wavelength at the design frequency, the reflective wave generated between the first rectangular waveguide element 10 and the connection element 30 and the reflective wave generated between the second rectangular waveguide element 20 and the connection element 30 counteract each other, whereby the reflection loss is minimized. The design frequency of the twisted waveguide is 76.6 GHz at which the reflection loss is −60 dB as indicated by the bold line. Accordingly, an extremely low reflection-loss characteristic is achieved. Although the reflection loss increases as the frequency of the propagating electromagnetic wave deviates from the design frequency, a low reflection-loss characteristic in which the reflection loss is −40 dB or less within a relatively wide frequency range of 76 to 77 GHz is achieved.

Figure 4A:
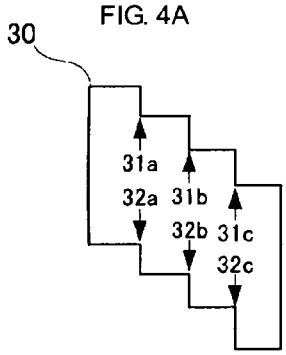
FIGS. 4A, and 4B are cross-sectional views each illustrating a connection element of a twisted waveguide according to a second and third embodiment of the present invention.
Figure 4B:
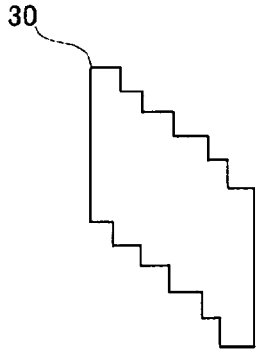

FIGS. 4A and 4B show twisted waveguides according to a second embodiment, respectively, of the invention. FIGS. 4A and 4B are cross-sectional views of connection elements having different structures taken along a plane perpendicular to the direction of electromagnetic-wave propagation, one of the connection elements being included in the twisted waveguide. In contrast to the first embodiment shown in FIG. 1 provided with two pairs of projections (a total of four projections) projected inward to face each other, the second embodiment shown in FIG. 4A is provided with three pairs of projections (a total of six projections). Furthermore, the third embodiment shown in FIG. 4B is provided with five pairs of projections (a total of 10 projections). Accordingly, the connection element 30 may be provided with a desired number of projections.

Figure 5:
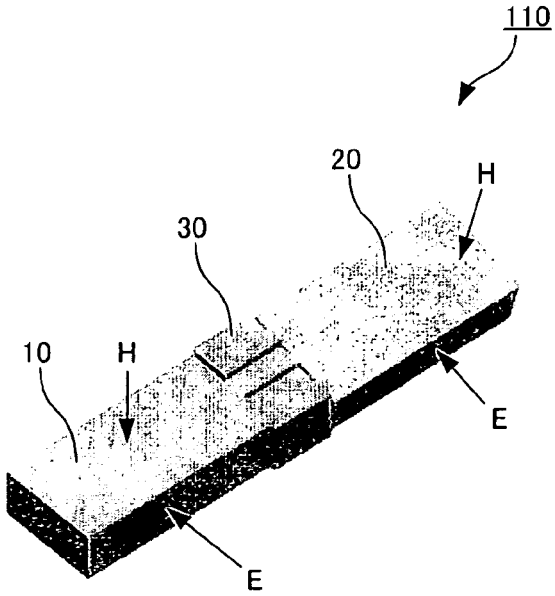
FIG. 5 is a perspective view illustrating a three-dimensional configuration of an electromagnetic-wave propagation path of a twisted waveguide according to a fourth embodiment of the present invention.

FIG. 5 illustrates a twisted waveguide according to a fourth embodiment. In this embodiment, H plane of the second rectangular waveguide element 20 is inclined at an angle of 15° with respect to H plane of the first rectangular waveguide element 10. This means that the connection element 30 rotates the plane of polarization of an electromagnetic wave propagating through the connection element 30 by an angle of 15°. Consequently, when the rotation angle is to be reduced, the angle of inclination of the staircase portion of the connection element 30 is made smaller, whereby the height of each step of the staircase is reduced. In contrast, if the rotation angle is to be increased, the angle of inclination of the staircase portion of the connection element 30 is made larger, whereby the height of each step of the staircase is increased.

A twisted waveguide according to a fifth embodiment will now be described with reference to FIGS. 6A through 7D.

Figure 6A:
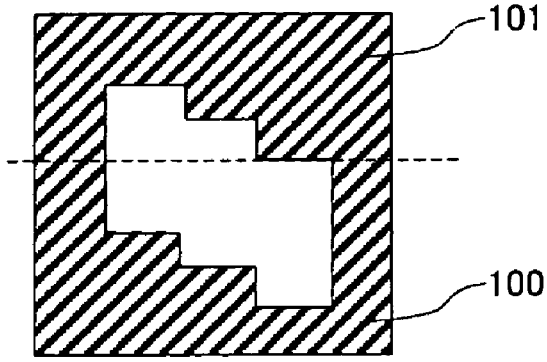
FIGS. 6A, 6B and 6C are cross-sectional views illustrating three structural types of a connection element of a twisted waveguide according to a fifth embodiment of the present invention.
Figure 6B:
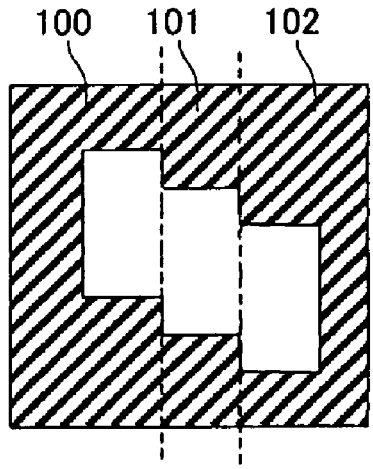
Figure 6C:
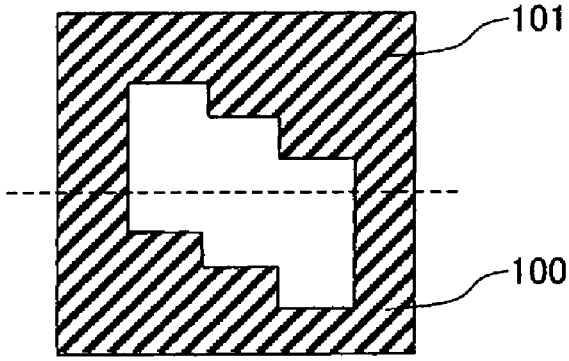

Each of the drawings mentioned above illustrates only the internal structure of the electromagnetic-wave propagation path. Specifically, the twisted waveguide can be be formed by assembling together a plurality of metal blocks having grooves formed therein by, for example, cutting. FIGS. 6A–6C show three examples of such an assembly. Each diagram is a cross-sectional view of the connection element taken along a plane perpendicular to the direction of electromagnetic-wave propagation. A broken line in the diagrams corresponds to an attachment plane (dividing plane) between metal blocks. The relationship between the connection element and the first and second rectangular waveguide elements is the same as that shown in FIGS. 1 and 2. In each of FIGS. 6A and 6C, a plane parallel to H plane of the first rectangular waveguide element functions as a dividing plane. Specifically, in FIG. 6A, the dividing plane is set such that a groove formed in a metal block 101 has a smaller number of inner surfaces therein. On the other hand, FIG. 6C, the dividing plane is set across the center of the connection element such that grooves provided in upper and lower metal blocks 100, 101 are symmetrical to each other.

In an example shown in FIG. 6B, planes parallel to E plane of the first rectangular waveguide element function as dividing planes. Each dividing plane is set such that upper and lower projections of a corresponding pair facing each other is included in the same dividing plane. According to this structure, the shape of grooves provided in metal blocks 100, 101, and 102 is simplified, thereby achieving an easier machining process.

Figure 7A:
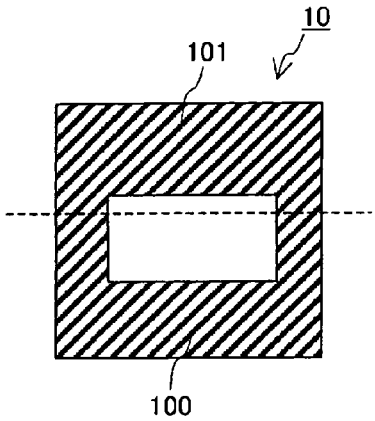
FIGS. 7A–7D are cross-sectional views of the elements of the twisted waveguide according to the fourth embodiment.
Figure 7B:
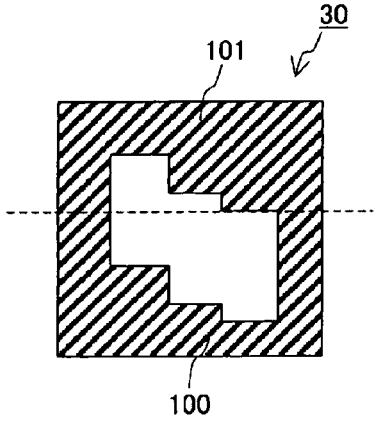
Figure 7C:
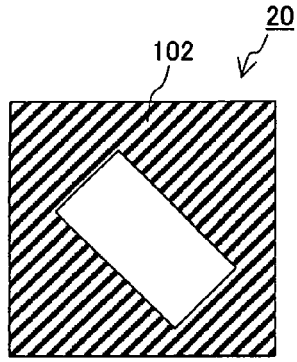
Figure 7D:
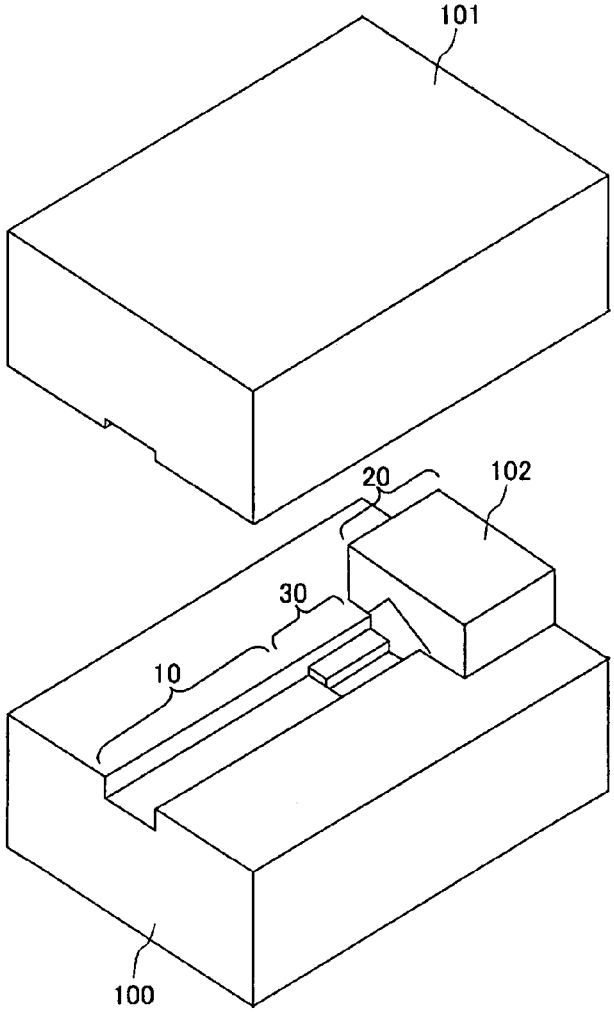

FIG. 7A–7D are cross-sectional views of the elements including the first and second rectangular waveguide elements in a case where the connection element has the structure shown in FIG. 6A. FIG. 7D is an exploded perspective view of this twisted waveguide. FIG. 7A is a cross-sectional view of the first rectangular waveguide element 10, FIG. 7B is a cross-sectional view of the connection element 30, and FIG. 7C is a cross-sectional view of the second rectangular waveguide element 20.

An upper metal block 101 and a lower metal block 100 are each provided with a groove for forming the first rectangular waveguide element 10 and the connection element 30. The lower metal block 100 is integrally provided with a protrusion 102 in which the second rectangular waveguide element 20 is provided. On the other hand, the upper metal block 101 is provided with a recess which engages with this protrusion 102.

By setting the dividing plane in this manner, the shapes of the grooves provided in the metal blocks 100, 101 for forming the first rectangular waveguide element 10 and the connection element 30 are simplified, thereby achieving an easier manufacturing process.

Figure 8:
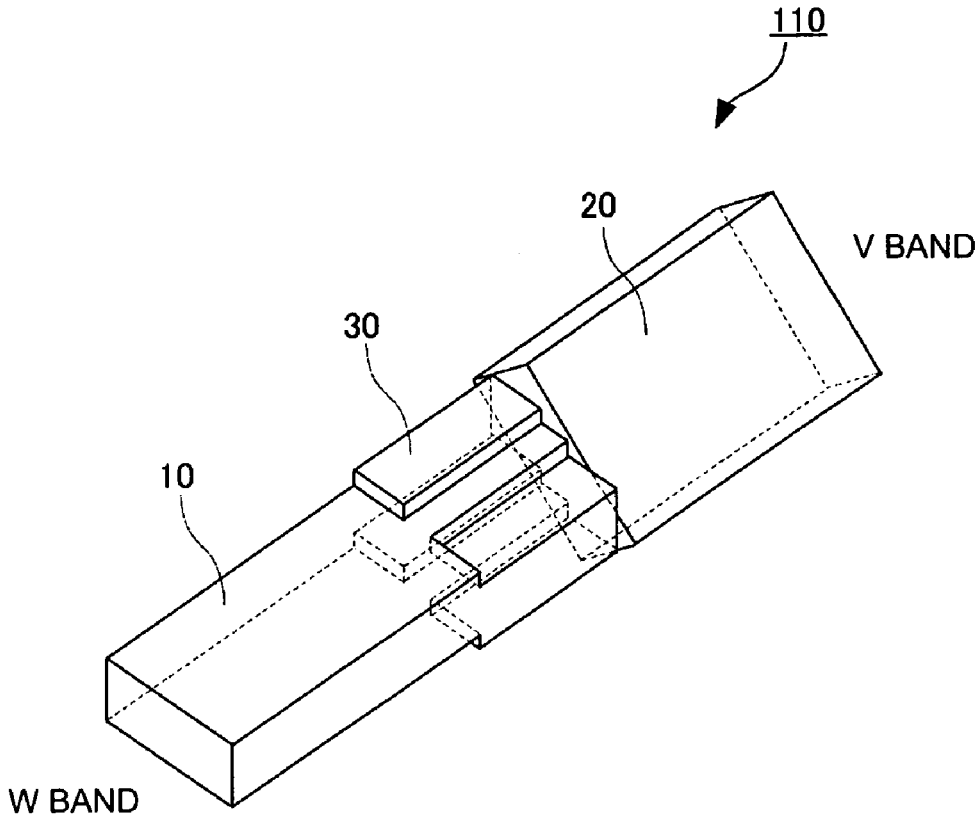
FIG. 8 is a perspective view illustrating a three-dimensional configuration of an electromagnetic-wave propagation path of a twisted waveguide according to a sixth embodiment.

FIG. 8 is a perspective view of a twisted waveguide according to a sixth embodiment of the present invention. Although the first and second rectangular waveguide elements 10, 20 according to the embodiments shown in, for example, FIGS. 1 and 5 have the same size, these two elements may have different sizes. In the embodiment shown in FIG. 8, the first rectangular waveguide element 10 is a W-band rectangular waveguide element (75 to 110 GHz) having a preferred size of 2.54 mm×1.27 mm, and the second rectangular waveguide element 20 is a V-band rectangular waveguide element (50 to 75 GHz) having a preferred size of 3.10 mm×1.55 mm.

When dealing with a signal of a 75-GHz band, a W-band rectangular waveguide element and a V-band rectangular waveguide element may both be used. As shown in FIG. 8, the second rectangular waveguide element 20 whose H plane is inclined in the direction of inclination of the staircase of the connection element 30 is given a larger size than the first rectangular waveguide element 10 so that the structural difference between the connection element 30 and the second rectangular waveguide element 20 is small. Thus, the reflection at the bordering section between these elements is maintained at a small amount.

Figure 9A:
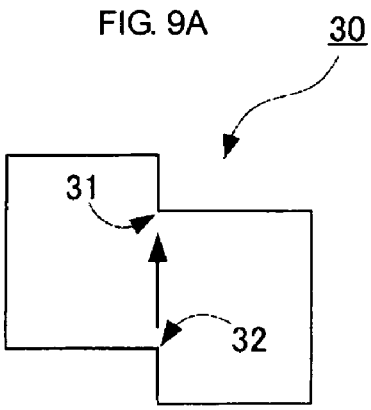
FIGS. 9A and 9B are cross-sectional views each illustrating a connection element of a twisted waveguide according to a seventh and eighth embodiment of the invention.
Figure 9B:
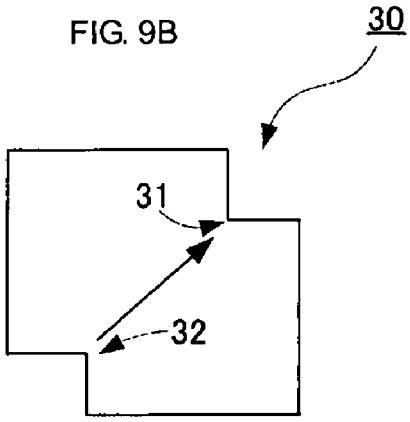

FIGS. 9A and 9B show a main portion of a twisted waveguide according to a seventh and eighth, rspectively, of the present invention embodiment. In these embodiments, a pair of projections 31, 32 (a total of two projections) facing each other is provided. In FIGS. 9A and 9B the direction of inclination of the staircase of the connection element 30 corresponds to the direction in which H plane of the second rectangular waveguide element is inclined such that a plane of polarization of an electromagnetic wave can be rotated. In FIG. 9A, however, since the two projections 31, 32 face each other in a direction parallel to E plane of the first rectangular waveguide element, a region in which the electric field is concentrated due to the two projections 31, 32 extends parallel to E plane of the first rectangular waveguide element. This results in a low ability for rotating the plane of polarization of an electromagnetic wave propagating through the connection element 30 towards the plane of polarization in the second rectangular waveguide element. In contrast, in FIG. 9B, a plane extending between the projections 31, 32 facing each other is inclined towards E plane of the second rectangular waveguide element with respect to E plane of the first rectangular waveguide element. Thus, the electric field that is concentrated in a region between the two projections 31, 32 is tilted towards E plane of the second rectangular waveguide element. Accordingly, when the electromagnetic wave entering from the first rectangular waveguide element propagates through the connection element 30, the electromagnetic wave is efficiently rotated towards E plane of the second rectangular waveguide element. According to this structure provided with only a single pair of projections, a rotating effect for the plane of polarization of the electromagnetic wave can still be achieved.

A twisted waveguide according to a ninth embodiment will now be described with reference to FIGS. 10*a* through 10E and 11.

Figures 10A, 10B, 10C, 10D, 10E:
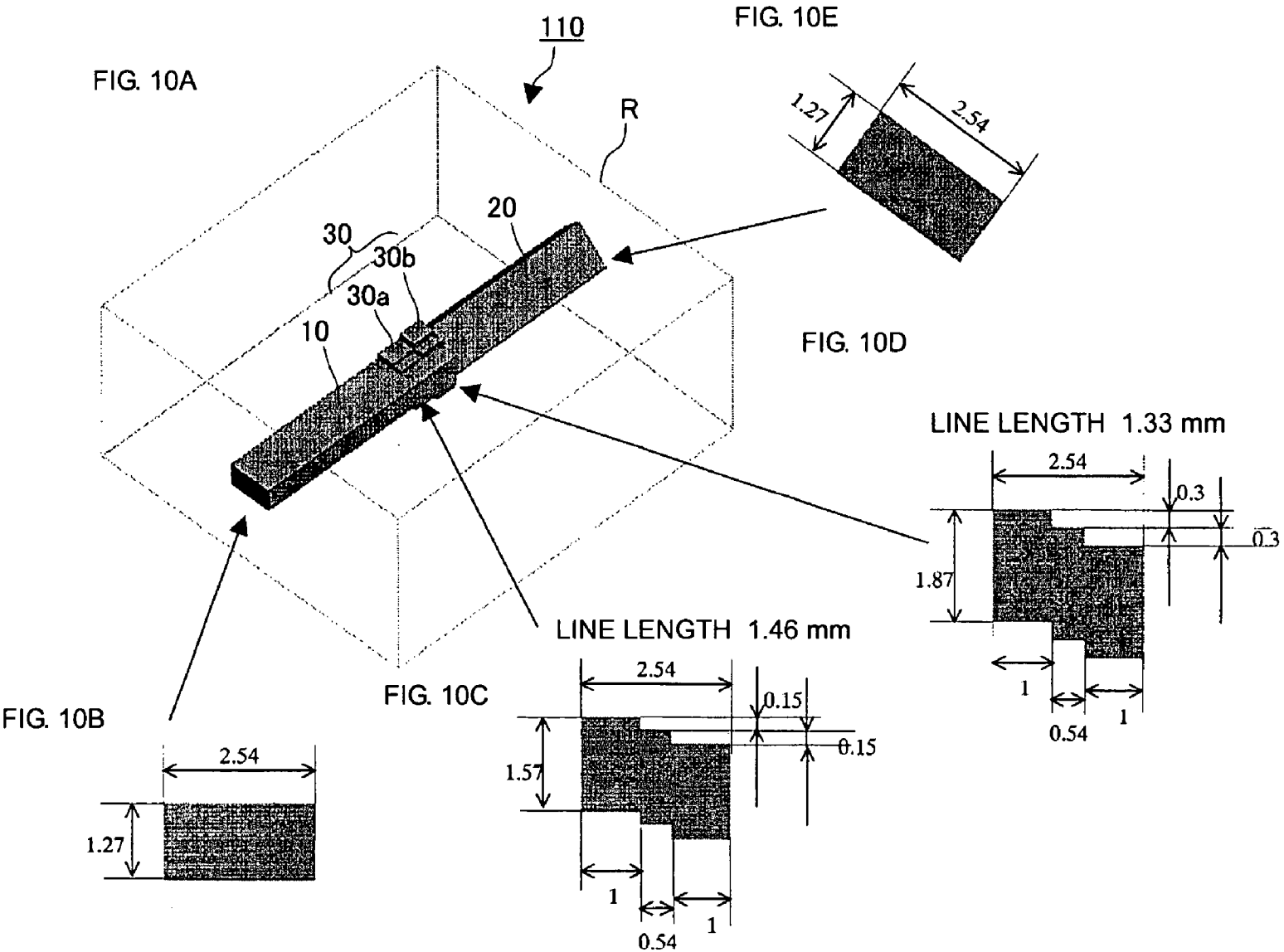
FIG. 10A is a three-dimensional configuration of an electromagnetic-wave propagation path of a twisted waveguide according to a ninth embodiment.
FIGS. 10B–10E are cross-sectional views of the elements of FIG. 10A.

FIG. 10A is a perspective view illustrating a three-dimensional configuration of the electromagnetic-wave propagation path. An edge line R forming a hexahedron indicates an outline of assembled metal blocks that form the waveguide elements. The first rectangular waveguide element 10 and the second rectangular waveguide element 20 have the connection element 30 disposed therebetween, and moreover, the connection element 30 includes a first connection subelement 30*a* and a second connection subelement 30*b* in this embodiment. FIG. 10B is a cross-sectional view of the first rectangular waveguide element 10,FIG. 10C is a cross-sectional view of the first connection subelement 30*a*, FIG. 10D is a cross-sectional view of the second connection subelement 30*b*, and FIG. 10E is a cross-sectional view of the second rectangular waveguide element 20. The dimensions of the elements shown in these diagrams are in millimeter units. Furthermore, the line length of the first connection subelement 30*a* in the direction of electromagnetic-wave propagation is preferably 1.46 mm, and the line length of the second connection subelement 30*b* in the direction of electromagnetic-wave propagation is preferably 1.33 mm. The total line length of the first and second connection subelements 30*a*, 30*b* is ½ of a guide wavelength with respect to a frequency of an electromagnetic wave to be propagated through the first and second connection subelements. Furthermore, the polarity of the reflection coefficient at the bordering section between the first rectangular waveguide element 10 and the first connection subelement 30*a* is opposite to the polarity of the reflection coefficient at the bordering section between the second rectangular waveguide element 20 and the second connection subelement 30*b*. Accordingly, two reflective waves generated at the two bordering sections counteract each other, whereby a low reflection-loss characteristic can be achieved.

According to the connection element provided with two stages, the rotation angle of a plane of polarization at each stage is advantageously smaller, and moreover, the reflection loss at each bordering section is also smaller. As a result, a twisted waveguide entirely having a low reflection-loss characteristic can be obtained. Moreover, since the total line length of the connection element is ½ of the guide wavelength, the entire structure does not need to be increased in size.

Alternatively, each of the line lengths of the first and second connection subelements 30*a* and 30*b* may be set at ½ of a guide wavelength with respect to a frequency of an electromagnetic wave to be propagated through the corresponding connection subelement. This further achieves a lower reflection-loss characteristic.

Each of the surfaces of the second rectangular waveguide element 20 is inclined at an angle of 45° with respect to the first rectangular waveguide element 10. Accordingly, a staircase portion of the first connection subelement 30*a* is inclined at an angle of approximately 15°, and a staircase portion of the second connection subelement 30*b* is inclined at an angle of approximately 30°. Thus, the plane of polarization in each of the first and second connection subelements 30*a*, 30*b* is rotated by approximately 22.5°, such that a total rotation angle of 45° is achieved.

Figure 11:
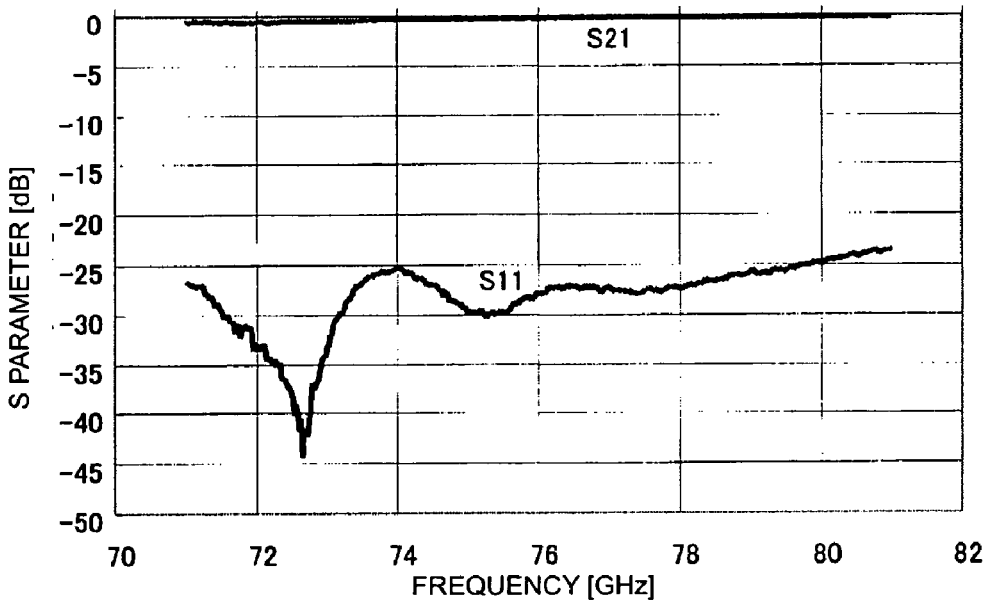
FIG. 11 illustrates S-parameter-versus-frequency characteristics of the twisted waveguide of FIG. 10A.

FIG. 11 illustrates S-parameter-versus-frequency characteristics of the twisted waveguide shown in FIG. 10A. According to a transmissive property S21, a low loss characteristic of −0.5 dB or less is achieved over the range of 71 to 81 GHz or more. Moreover, a low reflection characteristic of −25 dB or less is also achieved over the same frequency range.

An extremely-high-frequency radar according to an tenth embodiment will now be described with reference to FIGS. 12A, 12B and 13.

Figure 12A:
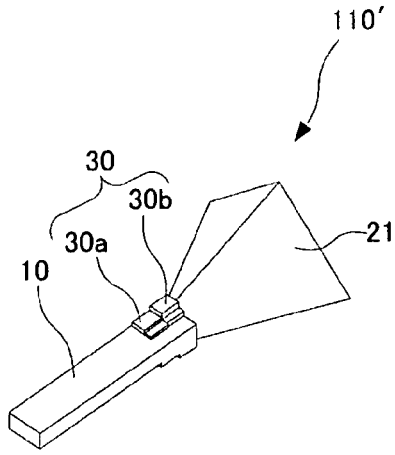
FIGS. 12A and 12B show a primary radiator and a dielectric-lens antenna provided in an extremely-high-frequency radar according to an tenth embodiment.
Figure 12B:
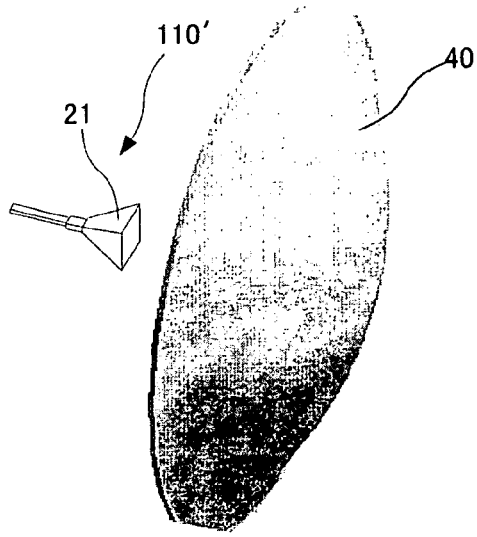

FIGS. 12A and 12B are perspective views of a dielectric-lens antenna provided in the extremely-high-frequency radar. FIG. 12A shows a primary radiator included in the dielectric-lens antenna. Here, a rectangular horn 21 corresponds to the second rectangular propagation path element according to the present invention. The connection element 30 including the first and second connection subelements 30*a*, 30*b* is disposed between the rectangular horn 21 and the first rectangular waveguide element 10. The connection element 30 rotates a plane of polarization of an electromagnetic wave propagating through the connection element 30. Accordingly, the first rectangular waveguide element 10, the connection element 30, and the rectangular horn 21 constitute a primary radiator 110'.

FIG. 12B the structure of the dielectric-lens antenna. The rectangular horn 21 of the primary radiator 110' is disposed near a focal position of a dielectric lens 40, and can be relatively shifted with respect to the dielectric lens 40 so as to scan sending and receiving wave beams. Although a rectangular horn is provided in the primary radiator in this embodiment, the primary radiator may alternatively be provided with, for example, a cylindrical horn, a patch antenna, a slot antenna, or a dielectric rod antenna.

Figure 13:
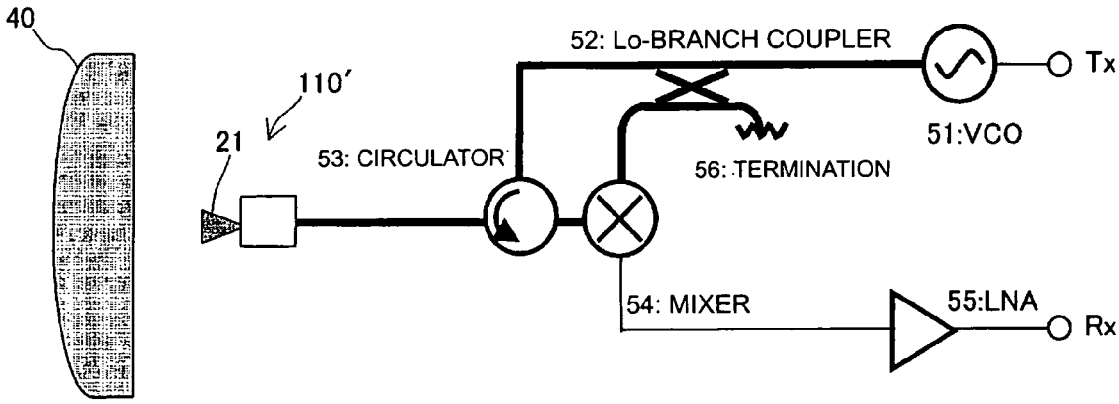
FIG. 13 is a block diagram illustrating a signal system of the extremely-high-frequency radar.
Figure 14:
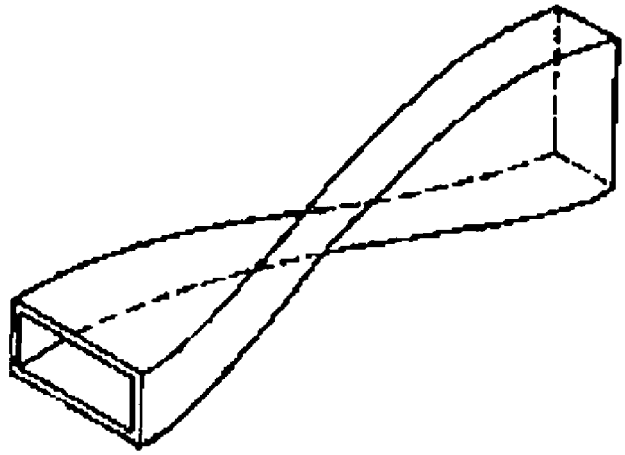
FIG. 14 PRIOR ART
FIG. 14 is a perspective view of a conventional twisted waveguide.
Figure 15:
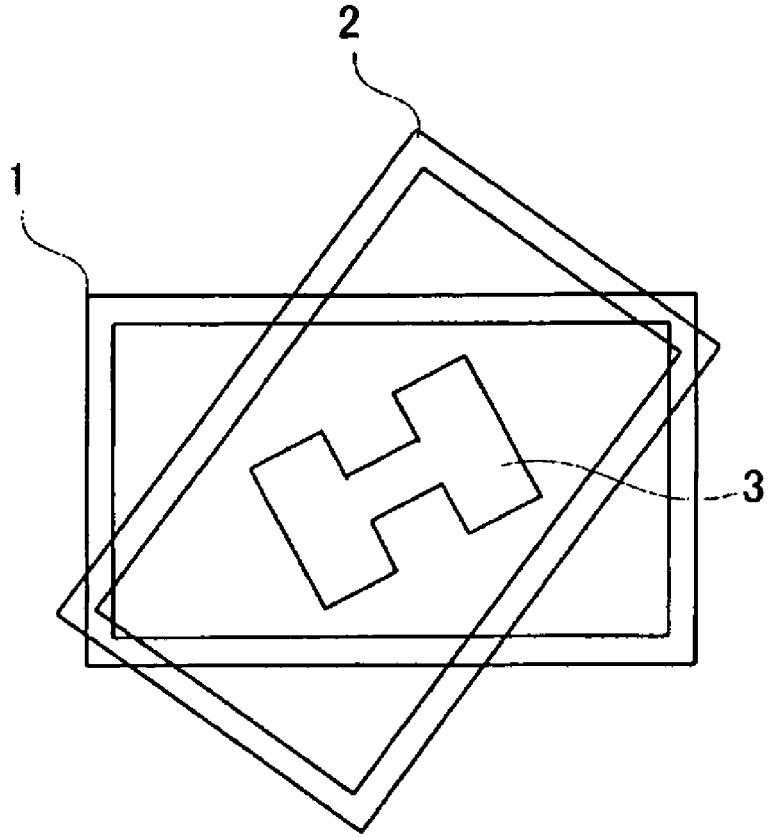
FIG. 15 PRIOR ART
FIG. 15 illustrates a twisted waveguide according to Patent Document 1.

FIG. 13 is a block diagram illustrating a signal system of the extremely-high-frequency radar provided with the dielectric-lens antenna. In FIG. 13, VC051 indicates a voltage controlled oscillator which is provided with, for example, a varactor diode and one of a Gunn diode and an FET, and which sends an oscillation signal to a Lo-branch coupler 52 via an NRD guide. The Lo-branch coupler 52 is a directional coupler including the NRD guide that extracts a portion of a sending signal as a local signal. A circulator 53 is an NRD-guide circulator which sends the sending signal to the rectangular horn 21 of the primary radiator in the dielectric-lens antenna, or transmits a receiving signal received from the rectangular horn 21 to a mixer 54. The mixer 54 mixes the receiving signal from the circulator 53 and the local signal together so as to output a receiving signal Rx of an intermediate frequency. A signal processing circuit, which is not shown, controls a mechanism that positionally shifts the rectangular horn 21 of the primary radiator 110'. Moreover, the signal processing circuit also detects the distance to a target and a relative speed based on the relationship between a modulating signal Tx of the VC051 and the receiving signal Rx. As a transmission line other than the first rectangular waveguide element 10 of the primary radiator 110', an MSL may be used instead of the NRD guide.

The invention claimed is:

1. A twisted waveguide comprising:

first and second rectangular propagation path elements having different planes of polarization; and a connection element connecting the first and second rectangular propagation path elements, wherein the connection element has a fixed line length in a direction of electromagnetic-wave propagation of the first and second rectangular propagation path elements, and wherein the connection element includes projections which project inward so as to face each other, the projections concentrating an electric field of an electromagnetic wave entering from the first or second rectangular propagation path element and rotating a plane of polarization of the electromagnetic wave propagating through the connection element, and wherein an inner periphery of the connection element surrounding a central axis extending in the direction of electromagnetic-wave propagation of the first and second rectangular propagation path elements includes surfaces substantially parallel to an H plane and an E plane of the first rectangular propagation path element, said surfaces forming a staircase such that abutting sections between the surfaces parallel to the H plane and the surfaces parallel to the B plane form the projections, the staircase being inclined in a direction corresponding to a direction in which an H plane of the second rectangular propagation path element is inclined.

2. The twisted waveguide according to claim 1, wherein the projections comprise two projections provided at two positions, wherein a plane extending between the two projections is inclined towards an E plane of the second rectangular propagation path element with respect to the E plane of the first rectangular propagation path element.

3. The twisted waveguide according to claim 1, wherein the line length of the connection element in the direction of electromagnetic-wave propagation is substantially ½ of a guide wavelength with respect to a frequency of an electromagnetic wave to be propagated through the connection element.

4. The twisted waveguide according to claim 1, wherein the connection element comprises a plurality of subelements disposed at multiple positions in the direction of electromagnetic-wave propagation.

5. A wireless device comprising the twisted waveguide according to claim 1; and an antenna connected to one of the first and second rectangular propagation path elements included in the twisted waveguide.

* * * * *